US011832734B2

(12) United States Patent
Weber

(10) Patent No.: US 11,832,734 B2
(45) Date of Patent: Dec. 5, 2023

(54) CHAIR

(71) Applicants: HYUNDAI LIVART FURNITURE CO.,LTD., Yongin-si (KR); JINWON. CO., LTD., Hwaseong-si (KR); Studio Weber and Associates, Minneapolis, MN (US)

(72) Inventor: Jeffrey Allen Weber, Minneapolis, MN (US)

(73) Assignees: HYUNDAI LIVART FURNITURE CO., LTD., Yongin-si (KR); JINWON CO., LTD., Hwaseong-si (KR); Studio Weber and Associates, Minneapolis, MN (US)

( * ) Notice: Subject to any disclaimer, the term of this patent is extended or adjusted under 35 U.S.C. 154(b) by 22 days.

(21) Appl. No.: 17/868,808

(22) Filed: Jul. 20, 2022

(65) Prior Publication Data

US 2023/0200540 A1 Jun. 29, 2023

(30) Foreign Application Priority Data

Dec. 29, 2021 (KR) ..... 10-2021-0191854

(51) Int. Cl.
*A47C 7/44* (2006.01)

(52) U.S. Cl.
CPC ..... *A47C 7/441* (2013.01)

(58) Field of Classification Search
CPC ..... A47C 7/441
USPC ..... 297/270.1, 300.6, 301.5, 312
See application file for complete search history.

(56) References Cited

U.S. PATENT DOCUMENTS 3,142,514 A * 7/1964 Ginat ..... A47C 7/002 D6/365
4,529,247 A 7/1985 Stumpf et al.
5,039,163 A * 8/1991 Tolleson ..... A47C 7/445 297/297
5,102,196 A * 4/1992 Kaneda ..... A47C 3/12 297/285
5,577,811 A * 11/1996 Ogg ..... A47C 3/12 297/284.4
5,902,012 A * 5/1999 Han ..... A47C 7/44 297/285
5,997,094 A * 12/1999 Cvek ..... A47C 3/12 297/284.4
6,406,096 B1 * 6/2002 Barile, Sr. ..... A47C 7/445 297/296
6,471,293 B2 * 10/2002 Ware ..... A47C 7/445 297/285

(Continued)

FOREIGN PATENT DOCUMENTS

DE 3303265 A1 * 8/1984 ..... A47C 7/441
GB 2165445 A * 4/1986 ..... A47C 1/03205

(Continued)

*Primary Examiner* — Rodney B White
(74) *Attorney, Agent, or Firm* — Revolution IP, PLLC

(57) ABSTRACT

A chair includes a seat, a backrest, and an elastic link. The seat supports a user's buttocks, wherein the backrest supports the user's back, the elastic link elastically connects a side portion of the seat to a side portion of the backrest, the seat includes a seat free end formed at a rear portion thereof without being connected to the backrest and the backrest includes a backrest free end formed at a lower portion thereof without being connected to the seat.

6 Claims, 10 Drawing Sheets

(56) References Cited

U.S. PATENT DOCUMENTS

| | | | | |
|---|---|---|---|---|
| 6,896,327 | B1 * | 5/2005 | Barile, Sr. | A47C 7/445<br>297/285 |
| 7,387,339 | B2 * | 6/2008 | Bykov | A47C 7/024<br>297/354.11 |
| 8,388,064 | B2 * | 3/2013 | Bertolini | A47C 7/445<br>297/285 |
| 10,427,762 | B1 * | 10/2019 | Mosher | B63B 29/06 |
| 2014/0062154 | A1 * | 3/2014 | Minino | A47C 7/445<br>297/301.1 |

FOREIGN PATENT DOCUMENTS

| | | | |
|---|---|---|---|
| JP | 05-060347 | U | 8/1993 |
| JP | 2017-169965 | A | 9/2017 |
| KR | 10-2014-0093055 | A | 7/2014 |
| WO | 2020-252191 | A1 | 12/2020 |

* cited by examiner (a)

(b)

(a)

(b)

(a)

(b)

CHAIR

FIELD

The present invention relates to a chair and, more particularly, to a chair which can equally support a user's back and buttocks regardless of user weight.

BACKGROUND

A chair is an essential piece of furniture in everyday life and is designed to accommodate a person sitting and working. Especially, for those who need to sit for a long time, such as students and office workers, an ergonomic chair designed to allow a user to maintain a comfortable and correct sitting posture is needed.

Posture of sitting on a chair restricts and reduces movement of a user's body, causing application of repeated excessive load. Particularly, due to restricted movement of the user's body, the weight of the user's upper body is concentrated on the user's back and buttocks, causing reduction in overall blood circulation in the body. Moreover, such a stationary sitting posture can adversely affect physical health and can cause problems due to lack of exercise, such as muscle tension and stiffness in the whole body.

In order to solve these problems, conventional chairs mostly include a backrest designed to be tilted backward at a predetermined angle to provide a comfortable sitting posture. However, since such a chair cannot be deformed or operated in other ways, a user can feel fatigued when sitting on the chair for a long time.

In addition, a conventional chair having an elastic means allowing elastic deformation of a seat and a backrest cannot provide an optimal deformation angle for a comfortable sitting posture since the degree of elastic deformation of the seat and the backrest varies depending on user weight.

RELATED LITERATURE

Patent Document

Korean Patent Laid-open Publication No. 10-2014-0093055 (Publication date: 2014 Jul. 25, Title: Chair seat having elastic means)

SUMMARY

Embodiments of the present invention are conceived to solve such problems in the art and it is an aspect of the present invention to provide a chair which includes a seat and a backrest separated from each other at a rear end of the seat and at a lower end of the backrest and thus can equally support a user's back and buttocks regardless of user weight.

In accordance with one aspect of the present invention, a chair includes: a seat supporting a user's buttocks; a backrest supporting the user's back; and an elastic link elastically connecting a side portion of the seat to a side portion of the backrest, wherein the seat has a seat free end formed at a rear portion thereof without being connected to the backrest, the backrest has a backrest free end formed at a lower portion thereof without being connected to the seat, and the backrest free end is disposed under the seat free end and is moved upwards to support the seat free end when a user is seated on the chair.

The chair may further include: a first cut-out formed between the side portion of the seat and the elastic link to separate the seat from the elastic link; and a second cut-out formed between the side portion of the backrest and the elastic link to separate the backrest from the elastic link.

The chair may further include: a lever disposed behind a starting point of the first cut-out and supporting a portion of the elastic link to restrict an area over which the elastic link is elastically deformed.

The seat may include a protrusion extending from a lower surface thereof, and the backrest may include a guide slit extending in a tilting direction of the backrest, wherein the protrusion is inserted into the guide slit such that the backrest is tilted as the protrusion is moved back and forth along the guide slit.

The chair may further include: a bearing protruding from the seat free end in the tilting direction of the backrest to reduce an area over which friction between the backrest free end and the seat free end occurs.

The chair may further include: a stopper formed at an end of the bearing to protrude farther than the bearing from the lower surface of the seat, the stopper restricting a tilting angle of the backrest.

The chair according to the present invention can equally support a user's back and buttocks regardless of user weight since the seat and the backrest are separated from each other at the rear end of the seat and at the lower end of the backrest while being elastically connected to each other by the elastic link.

In addition, the chair according to the present invention allows the backrest to be tilted to some extent for a light-weight user through adjustment of rigidity of the elastic link, thereby ensuring user comfort.

Further, the chair according to the present invention allows the elastic link to be elastically deformed to an angle optimal to sit in the chair while preventing the backrest from being excessively reclined, thereby improving user comfort and stability.

Furthermore, the chair according to the present invention can reduce an area over which friction between the backrest free end and the seat free end occurs, thereby allowing the backrest free end and the seat free end to smoothly support each other.

Moreover, the chair according to the present invention can prevent a user's waist from being excessively tilted while helping a user to maintain a stable posture.

DRAWINGS

The above and other aspects, features, and advantages of the present invention will become apparent from the detailed description of the following embodiments in conjunction with the accompanying drawings.

DETAILED DESCRIPTION

Hereinafter, exemplary embodiments of the present invention will be described in detail with reference to the accompanying drawings.

Figure 1:
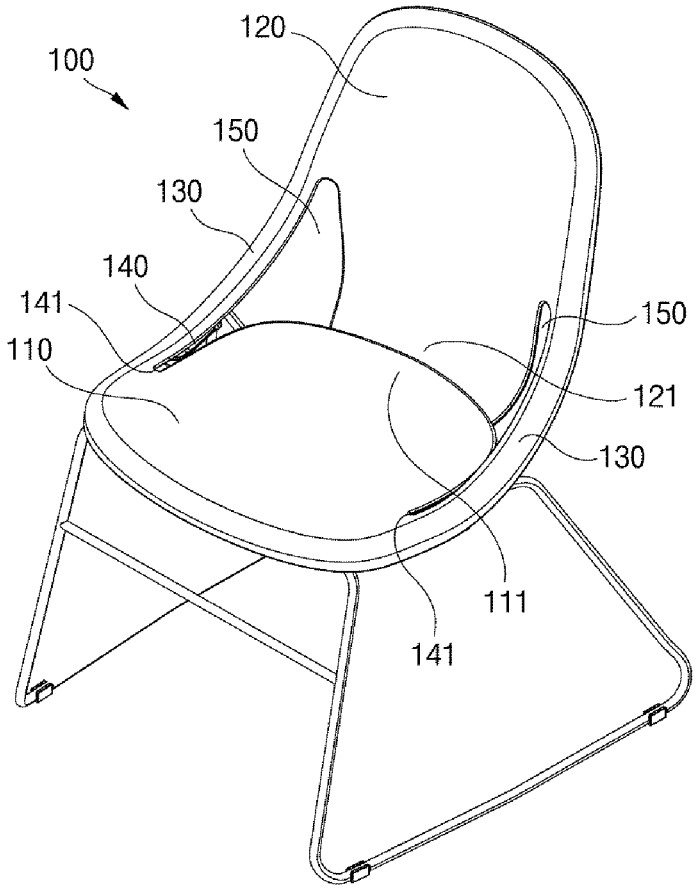
FIG. 1 is a view of a chair according to a first embodiment of the present invention.
Figure 2:
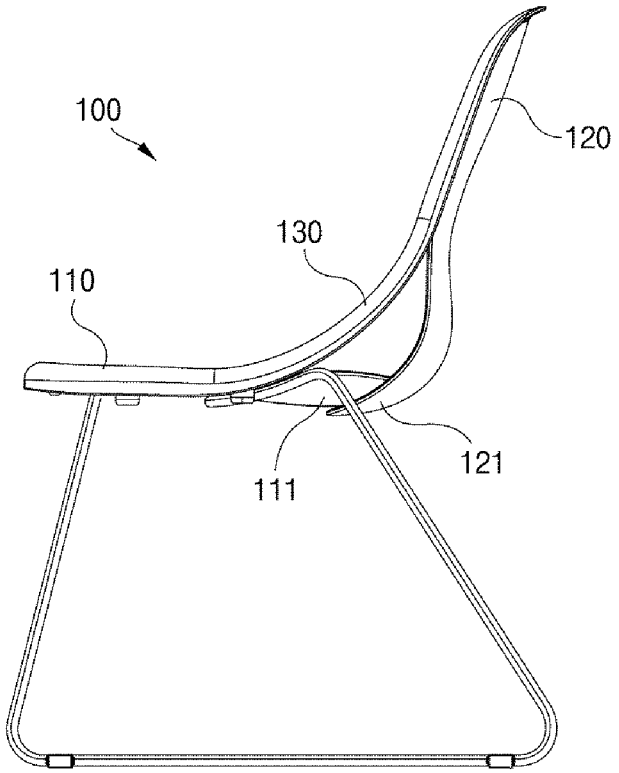
FIG. 2 is a side view of the chair of FIG. 1.
Figure 3:
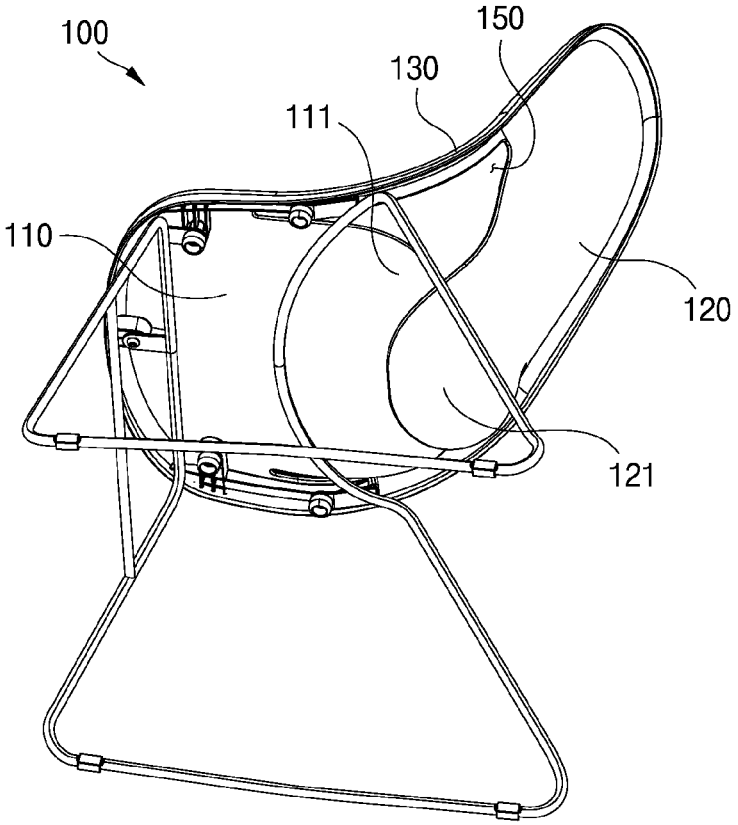
FIG. 3 is a bottom view of the chair of FIG. 1.

FIG. 1 is a view of a chair according to a first embodiment of the present invention, FIG. 2 is a side view of the chair of FIG. 1, and FIG. 3 is a bottom view of the chair of FIG. 1.

Referring to FIG. 1 and FIG. 3, the chair 100 according to this embodiment includes a seat 110, a backrest 120, an elastic link 130, a first cut-out 140, a second cut-out 150, and a lever 160.

The seat 110 supports a user's buttocks and has a seat free end 111. The seat free end 111 is formed at a rear portion of the seat 110 without being connected to the backrest 120.

A seat of a general chair is connected to a backrest, whereas the seat 110 according to the present invention is not connected to the backrest 120 and has the seat free end 111 at the rear portion thereof.

The backrest 120 supports a user's back and has a backrest free end 121. The backrest free end 121 is formed at a lower portion of the backrest 120 without being connected to the seat 110.

A backrest of a general chair is connected to a seat, whereas, similarly to the seat 110, the backrest 120 according to the present invention is not connected to the seat 110 and has the backrest free end 121 at the lower portion thereof.

The elastic link 130 elastically connects a side portion of the seat 110 to a side portion of the backrest 120.

That is, the seat 110 and the backrest 120 are separated from each other at the rear portion of the seat 110 or at the lower portion of the backrest 120 and are connected to each other at the side portion of the seat 110 and at the side portion of the backrest 120 by the elastic link 130.

When a user is seated on the chair 100, the backrest 120 is forced backward by the user's weight and the elastic link 130 is elastically deformed in a direction in which the seat 110 and the backrest 120 are moved away from each other. When a user rises from the chair 100, the force applied to the backrest 120 is removed and the elastic link 130 is elastically restored in a direction in which the seat 110 and the backrest 120 are moved toward each other.

Figure 4:
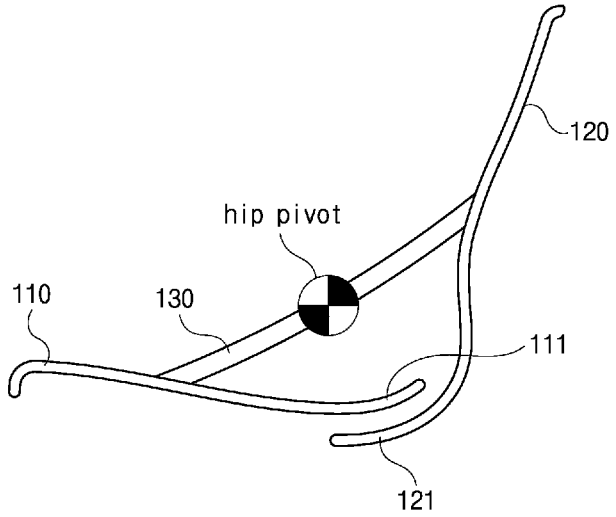
FIG. 4 is a view illustrating the shapes of a seat and a backrest when a user is seated on the chair of FIG. 1.
Figure 4:
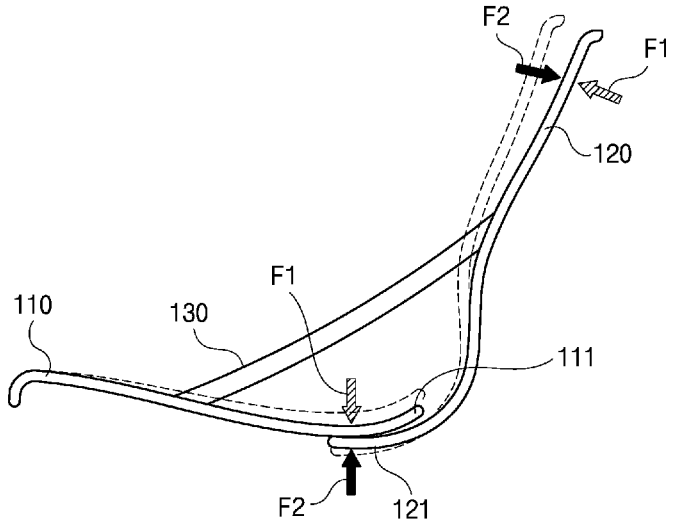

FIG. 4 is a view illustrating shapes of the seat and the backrest when a user is seated on the chair of FIG. 1. Next, the shapes of the seat 110 and the backrest 120 and a state in which the seat free end 111 is supported by the backrest free end 121 will be described with reference to FIG. 4.

Referring to FIG. 4(*a*), when the chair is empty, the seat 110 and the backrest 120 are not connected to each other at the rear end of the seat 110 and at the lower end of the backrest 120, that is, both the rear end of the seat 110 and the lower end of the backrest 120 are a free end.

The chair shell geometry, specifically the elastic link 130 is designed to articulate at the user's hip joint (hip pivot). This automatically aligns the surface of the seat 110 and the surface of the backrest 120 to the user's buttocks and the user's back/spine in a constant relationship throughout the accessible range of motion/postural range.

Referring to FIG. 4(*b*), when a user is seated on the chair, the seat 110 supporting the user's buttocks is forced downward by the user's weight and the backrest supporting the user's back is forced backward by the user's leaning weight against the backrest 120.

As a result, the seat free end 111 is moved downwards by the user's weight, an upper portion of the backrest 120 is tilted backward by the user's leaning weight against the backrest 120, and the backrest free end 121 formed at the lower portion of the backrest 120 and placed under the seat free end 111 is moved upwards and supports the seat free end 111.

That is, body mass input F1 is transferred from the seat 110 to the backrest 120, which increases the backrest 120 resistance to recline. Upper body mass input F2 is transferred from the backrest 120 to the seat 110, which lifts the user's buttocks/body mass which then increases the stiffness of the resistance in the system (backrest 120).

Figure 5:
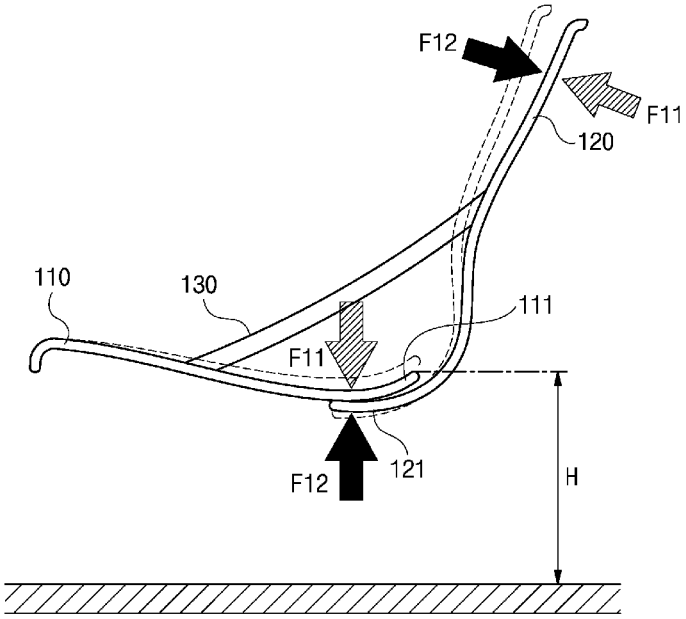
FIG. 5 is a view showing the shapes of the seat and the backrest when users having different weights are seated on the chair of FIG. 1.
Figure 5:
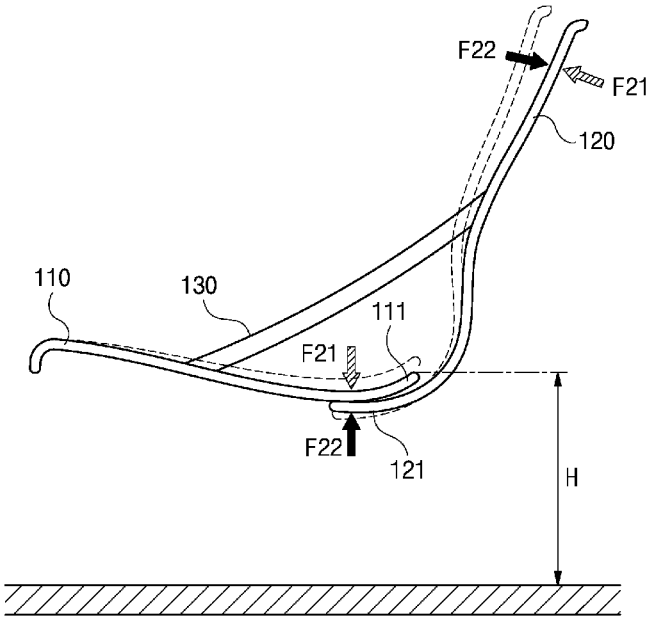

FIG. 5 is a view showing the shapes of the seat and the backrest when users having different weights are seated on the chair of FIG. 1

Referring to FIG. 5, since the seat free end 111 is supported from below by the backrest free end 121, the height H of the seat free end 111 is maintained at a constant value regardless of user weight.

Referring to FIG. 5(*a*), for a heavier user, larger downward force Flt is applied to the seat free end 111 while larger supporting force F12 is applied to the seat free end 111 by the backrest free end 121 since larger force F12 is applied to the backrest 120.

That is, as downward force F11 applied to the seat free end 111 increases, supporting force F12 applied to the seat free end 111 by the backrest free end 121 also becomes larger, whereby the downward force applied to the seat free end 111 balances the supporting force applied to the seat free end 111 by the backrest free end 121.

Referring to FIG. 5(*b*), for a lighter user, smaller downward force F21 is applied to the seat free end 111 while smaller supporting force F22 is applied to the seat free end 111 by the backrest free end 121 since smaller force F22 is applied to the backrest 120.

That is, as downward force F21 applied to the seat free end 111 decreases, supporting force F22 applied to the seat free end 111 by the backrest free end 121 also becomes smaller, whereby the downward force applied to the seat free end 111 balances the supporting force applied to the seat free end 111 by the backrest free end 121.

As such, since the downward force applied to the seat free end 111 balances the supporting force applied to the seat free end 111 by the backrest free end 121 regardless of user weight, the height H of the seat free end 111 can be maintained at a constant value.

Figure 6:
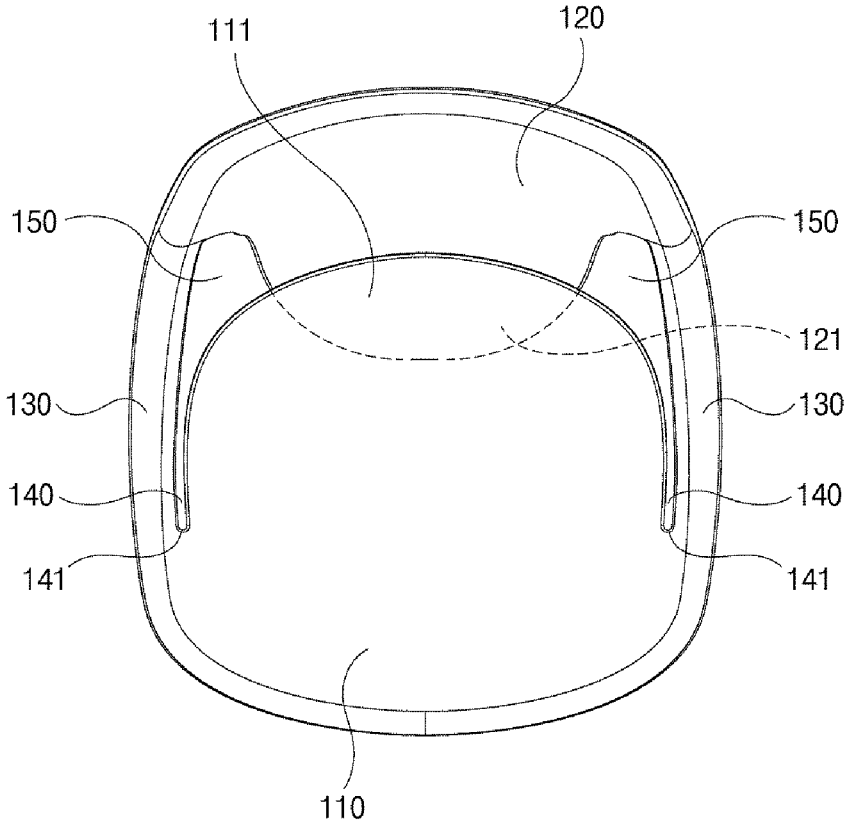
FIG. 6 is a top plan view of the chair of FIG. 1.

FIG. 6 is a top plan view of the chair of FIG. 1

Referring to FIG. 6, the first cut-out 140 may be formed between the side portion of the seat 110 and the elastic link 130 such that the seat 110 is separated from the elastic link 130 by the first cut-out 140.

The second cut-out 150 may be formed between the side portion of the backrest 120 and the elastic link 130 such that the backrest 120 is separated from the elastic link 130 by the second cut-out 150.

If there are no cut-outs separating the seat 110 and the backrest 120 from the elastic link 130, the elastic link 130 can hardly be elastically deformed due to significantly high rigidity of the elastic link 130 when a light user is seated on the chair.

In this case, even when a user is seated on the chair, the backrest 120 remains in a vertical position with little or no tilt and the backrest free end 121 does not support the seat free end 111, causing reduction in user comfort.

According to the present invention, the first cut-out 140 and the second cut-out 150 allow the backrest 120 to be tilted to some extent for a light user through adjustment of rigidity of the elastic link 130, thereby ensuring user comfort.

Figure 7:
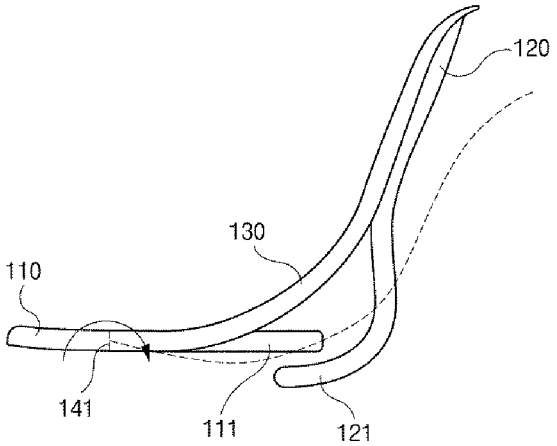
FIG. 7 is a view of a lever of the chair of FIG. 1.
Figure 7:
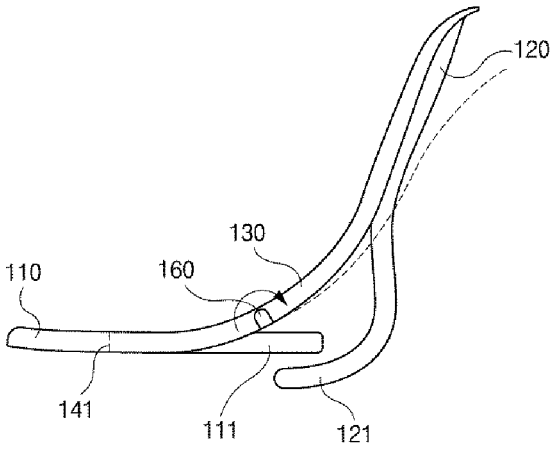

FIG. 7 is a view of the lever of the chair of FIG. 1.

Referring to FIG. 7, the lever 160 may be disposed behind a starting point 141 of the first cut-out 140 and may support a portion of the elastic link 130 to restrict an area over which the elastic link 130 is elastically deformed.

Without the lever 160, when the backrest 120 is reclined and the elastic link 130 elastically connected to the backrest 120 is also reclined toward the backrest 120, elastic deformation of the elastic link 130 would occur over a region behind the starting point 141 of the first cut-out 140, as shown in FIG. 7(*a*), causing the elastic link 130 to be reclined over an excessively large area.

In this case, the elastic link 130 is easily or excessively reclined and thus can provide an unstable or uncomfortable sitting posture to a user, rather than a comfortable sitting posture.

According to this invention, the lever 160 restricts elastic deformation of the elastic link 130 to a region behind the lever 160, as shown in FIG. 6(*b*), thereby preventing the backrest 120 from being excessively reclined while providing the best angle to sit in the chair 100.

As such, the lever 160 allows the elastic link 130 to be elastically deformed to an angle optimal for sitting in the chair 100 while preventing the backrest 120 from being excessively reclined, thereby improving user comfort and stability.

Figure 8:
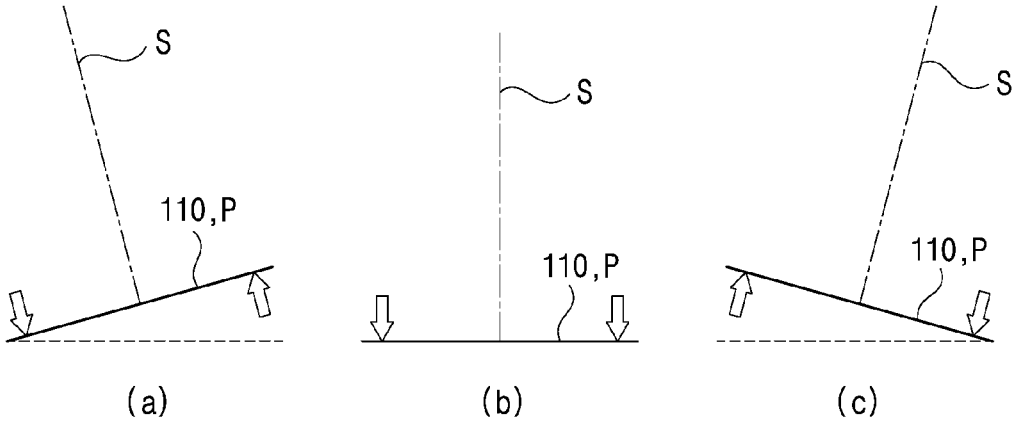
FIG. 8 is a view illustrating the shapes of the pelvis and spine of a user seated on the chair of FIG. 1.

FIG. 8 is a view illustrating the shapes of the pelvis and spine of a user seated on the chair of FIG. 1.

Referring to FIG. 8, since the seat 110 has the seat free end 111 at the rear portion thereof and the backrest 120 has the backrest free end 121 at the lower portion thereof such that the seat 110 and the backrest 120 are separated from each other, the spine s and pelvis p of a user seated on the chair can remain perpendicular to each other even when the user's pelvis p is tilted to the left or right.

When a user is seated on the chair in a posture slightly tilted to the left (see FIG. 8(*a*)), the left side of the seat 110 is moved downwards and the right side of the seat plate 110 is moved upwards, causing the entire seat 110 to be generally tilted to the left. Here, as the user's pelvis p is tilted to the left, the user's spine s is also tilted to the left, thereby allowing the user's spine s and pelvis p to remain perpendicular to each other.

When a user is seated on the chair in a posture slightly tilted to the right (see FIG. 8(*b*)), the right side of the seat 110 is moved downwards and the left side of the seat plate 110 is moved upwards, causing the entire seat 110 to be generally in a state of being tilted to the right. Here, as the user's pelvis p is tilted to the right, the user's spine s is also tilted to the right, thereby allowing the user's spine s and pelvis p to remain perpendicular to each other.

Legs of the chair according to this embodiment support a portion of the seat 110 and the elastic link 130.

As described above, the seat plate 110 has the seat free end 111 not connected to the backrest 120. Thus, if the legs do not support the seat 110, the seat 110 can be excessively moved downwards, causing user discomfort.

As described above, the elastic link 130 is also separated from the seat 110 by the first cut-out 140. Thus, if the legs do not support the elastic link 130, the elastic link 130 can be excessively tilted backward, causing a user discomfort.

Accordingly, the legs according to this embodiment support a portion of the seat 110 and the elastic link 130 to prevent the seat 110 from being excessively moved downwards or to prevent the elastic link 130 from being excessively tilted backward, thereby providing comfort and stability to a user seated on the chair.

However, it should be understood that the legs may have various other shapes without being limited to the shape shown in this embodiment.

Figure 9:
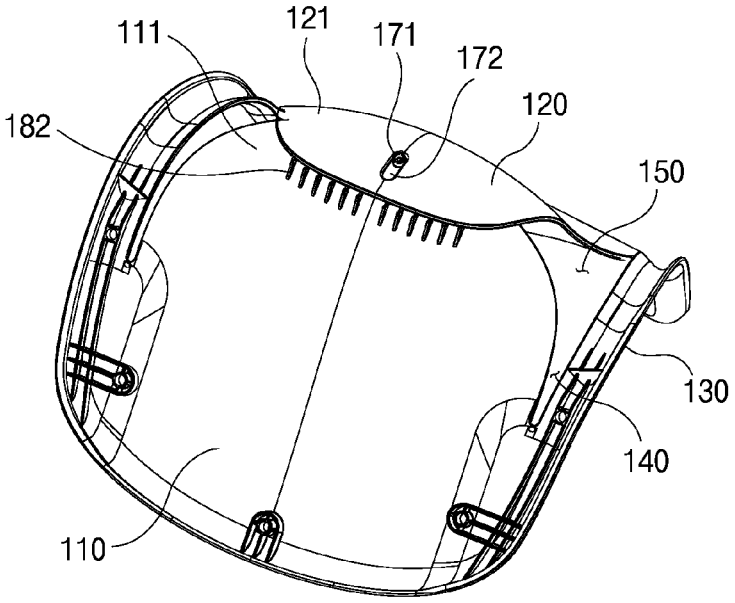
FIG. 9 and FIG. 10 are views illustrating a protrusion, a guide slit, a bearing, and a stopper of a chair according to a second embodiment of the present invention.
Figure 10:
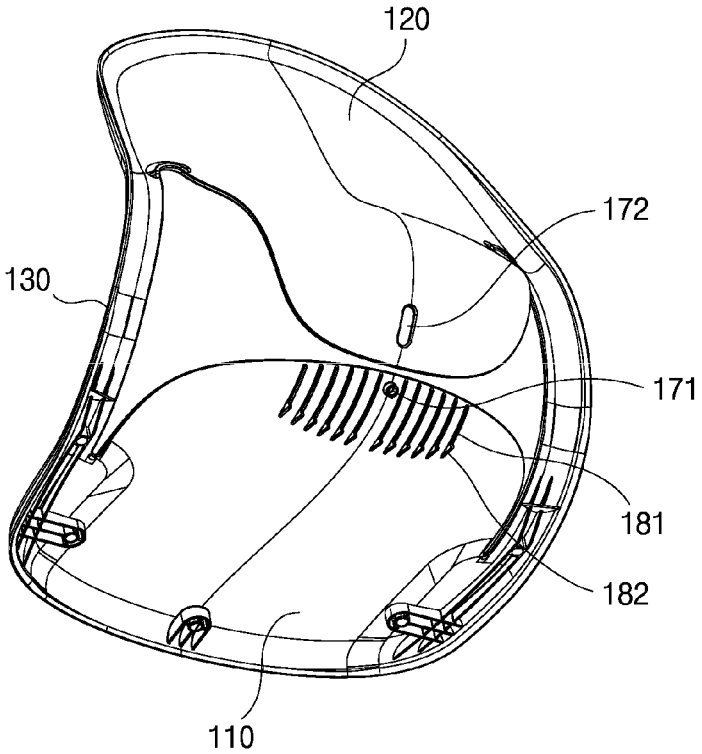

FIG. 9 and FIG. 10 are views illustrating a protrusion, a guide slit, a bearing, and a stopper of a chair according to a second embodiment of the present invention.

The chair according to this embodiment further includes a protrusion 171, a guide slit 172, a bearing 181, and a stopper 182.

Referring to FIG. 9 and FIG. 10, the seat 110 includes a protrusion 171 extending from a lower surface thereof, and the backrest 120 includes a guide slit 172 extending in a tilting direction of the backrest 120.

The protrusion 171 is inserted into the guide slit 172 such that the backrest 120 can be tilted as the protrusion 171 is moved back and forth along the guide slit 172.

Since the backrest 120 is tilted using a combination of the protrusion 171 and the guide slit 172, it is possible to restrict a tilting direction of the backrest 120 to a longitudinal direction of the guide slit 172.

The bearing 181 protrudes from the seat free end 111 in the tilting direction of the backrest 120 to reduce an area over which friction between the backrest free end 121 and the seat free end 111 occurs.

In this embodiment, the bearing 181 may be provided in the form of multiple lines protruding from a surface of the seat free end 111 and arranged at predetermined intervals.

As the backrest free end 121 is moved upwards to support the seat free end 111, contact and friction occur between the backrest free end 121 and the seat free end 111. Without the bearing 170, friction between the backrest free end 121 and the seat free end 111 would occur over a large area, making it difficult for the backrest free end 121 and the seat free end 111 to smoothly support each other.

The bearing 170 reduces an area over which friction between the bearing 170 and the backrest free end 121 occurs, thereby allowing the backrest free end 121 and the seat free end 111 to smoothly support each other.

The stopper 182 is formed at an end of the bearing 181 to restrict a tilting angle of the backrest 120.

The stopper 182 may extend from the bearing 181 to protrude farther than the bearing 181 from the lower surface of the seat 110. Thus, when the backrest 120 is on the point of tilting beyond a predetermined angle, the backrest free end 121 can be caught on the stopper 182, whereby the tilting angle of the backrest 120 can be restricted.

As such, the stopper 182 formed at the end of the bearing 181 can prevent a user's waist from being excessively tilted while helping a user to maintain a stable posture.

The chair according to the present invention can equally support a user's back and buttocks regardless of user weight since the seat and the backrest are separated from each other at the rear end of the seat and at the lower end of the backrest while being elastically connected to each other via the elastic link.

In addition, with the first cut-out and the second cut-out, the chair according to the present invention allows the backrest to be tilted to some extent for a lightweight user through adjustment of rigidity of the elastic link, thereby ensuring user comfort.

Further, with the lever, the chair according to the present invention allows the elastic link to be elastically deformed to an angle optimal to sit in the chair while preventing the backrest from being excessively reclined, thereby improving user comfort and stability.

Furthermore, with the bearing, the chair according to the present invention can reduce an area over which friction between the backrest free end and the seat free end occurs, thereby allowing the backrest free end and the seat free end to smoothly support each other.

Furthermore, with the stopper, the chair according to the present invention can prevent a user's waist from being excessively tilted while helping a user to maintain a stable posture.

While certain embodiments have been described, these embodiments have been presented by way of example only, and are not intended to limit the scope of the invention. Indeed, the embodiments described herein may be embodied in a variety of other forms. Furthermore, it should be understood that various modifications, variations, and alterations can be made by those skilled in the art without departing from the spirit and scope of the invention defined by the appended claims.

| <List of Reference numerals> | |
|---|---|
| 100: Chair | 110: Seat |
| 120: Backrest | 130: Elastic link |
| 140: First cut-out | 150: Second cut-out |

The invention claimed is:

1. A chair comprising:

a seat supporting a user's buttocks;

a backrest supporting the user's back; and an elastic link elastically connecting a side portion of the seat to a side portion of the backrest, wherein the seat has a seat free end formed at a rear portion thereof without being connected to the backrest, the backrest has a backrest free end formed at a lower portion thereof without being connected to the seat, and the backrest free end is disposed under the seat free end and is moved upwards to support the seat free end when a user is seated on the chair.

2. The chair according to claim 1, further comprising:

a first cut-out formed between the side portion of the seat and the elastic link to separate the seat from the elastic link; and a second cut-out formed between the side portion of the backrest and the elastic link to separate the backrest from the elastic link.

3. The chair according to claim 2, further comprising:

a lever disposed behind a starting point of the first cut-out and supporting a portion of the elastic link to restrict an area over which the elastic link is elastically deformed.

4. The chair according to claim 1, wherein:

the seat comprises a protrusion extending from a lower surface thereof;

the backrest comprises a guide slit extending in a tilting direction of the backrest; and the protrusion is inserted into the guide slit such that the backrest is tilted as the protrusion is moved back and forth along the guide slit.

5. The chair according to claim 4, further comprising:

a bearing protruding from the seat free end in the tilting direction of the backrest to reduce an area over which friction between the backrest free end and the seat free end occurs.

6. The chair according to claim 5, further comprising:

a stopper formed at an end of the bearing to protrude farther than the bearing from the lower surface of the seat, the stopper restricting a tilting angle of the backrest.

* * * * *